US005624476A

United States Patent [19]

Eyraud

[11] Patent Number: 5,624,476

[45] Date of Patent: Apr. 29, 1997

[54] METHOD AND DEVICE FOR PURIFYING GASEOUS EFFLUENTS

[75] Inventor: Charles Eyraud, Lyons, France

[73] Assignee: Ecoprocess, Neuilly sur Seine, France

[21] Appl. No.: 196,256

[22] PCT Filed: Aug. 20, 1992

[86] PCT No.: PCT/FR92/00811

§ 371 Date: Mar. 16, 1994

§ 102(e) Date: Mar. 16, 1994

[87] PCT Pub. No.: WO93/03849

PCT Pub. Date: Mar. 4, 1993

[30] Foreign Application Priority Data

Aug. 21, 1991 [FR] France ..... 91 10616

[51] Int. Cl.[6] ..... B03C 3/014

[52] U.S. Cl. ..... 95/65; 55/228; 95/71; 96/53

[58] Field of Search ..... 55/228, 242; 422/169, 422/178; 95/64, 65, 71, 74, 75; 96/44, 47, 50, 52, 53, 46, 45; 261/21, 22

[56] References Cited

U.S. PATENT DOCUMENTS

| | | | |
|---|---|---|---|
| 2,050,797 | 8/1936 | Kerschbaum et al. | 55/242 X |
| 2,874,802 | 2/1959 | Gustafsson et al. | 95/75 X |
| 3,404,513 | 10/1968 | Roberts | 96/27 |
| 3,509,695 | 5/1970 | Egan et al. | 96/50 X |
| 3,785,118 | 1/1974 | Robertson | 95/71 |
| 3,958,960 | 5/1976 | Bakke | 96/47 |
| 4,247,307 | 1/1981 | Chang | 96/45 X |
| 4,305,909 | 12/1981 | Willett et al. | 422/169 |

FOREIGN PATENT DOCUMENTS

| | | |
|---|---|---|
| 1406086 | 6/1965 | France . |
| 2216025 | 8/1974 | France . |
| 2229468 | 12/1974 | France . |
| 574079 | 4/1933 | Germany . |

*Primary Examiner*—Richard L. Chiesa
*Attorney, Agent, or Firm*—Oliff & Berridge

[57] ABSTRACT

A gas is purified using both mechanically atomized liquid and liquid dispersed by electrostatic atomization at asperities arranged at surfaces of emitting electrodes. The concentration of washing liquid between the make-up pipeline and discharge pipeline is obtained, on the one hand, by recycling using atomization pipes of a group of electrodes for the run-off liquid collected by an accumulation tank and, on the other hand, using a back-flow of the liquid between successive accumulation tanks through interconnecting pipelines. A physical and/or chemical treatment line for the liquids and the sludges is also associated with the gas treatment line.

7 Claims, 4 Drawing Sheets

METHOD AND DEVICE FOR PURIFYING GASEOUS EFFLUENTS

BACKGROUND OF THE INVENTION

MODES OF PRODUCTION OF A LIQUID MIST BETWEEN ELECTRODES

A gas can be purified highly efficiently by dispersing a liquid reactant between the electrodes of an electrostatic filter. Several methods have been employed, proposed or patented in order to produce a liquid mist in this type of contactor between three media, respectively gaseous, liquid and solid:

1) electrostatic nebulizing, at the asperities of the high-voltage electrodes, of a liquid coming from a reservoir with pressure head and electric charge (French Patent No. 1,406,086 of May 06, 1964)
2) electrostatic nebulizing, at the asperities of the electrodes at earth potential, of a liquid supplied through pipelines at the top of these electrodes
3) (primary) spraying, by means of mechanical, pneumatic or hydraulically pressurized atomizers at earth potential (U.S. Pat. No. 2,874,802 of Feb. 24, 1959 and French Patent No. 73,18584 of 22, May 1973)
4) electrostatic nebulizing, at the asperities of the high-voltage electrodes, of the liquid runoff supplied by primary spraying using atomizers at the earth potential (French Patent No. 74,17094 of 16, May 1974)
5) "to-and -fro" electrostatic nebulizing, at the asperities carried by two families of electrodes, respectively at high voltage and at earth potential (U.S. Pat. No. 3,785,118 of Jan. 15, 1974. This arrangement, called "bi-ionized field" promotes the agglomeration of the particles in suspension, to the detriment of their electrical sedimentation. It is not in general desirable because it promotes the return of sludge into suspension in the gas.

ADVANTAGES OF THE DISPERSION OF A LIQUID IN AN ELECTROSTATIC FILTER

The advantages expected from the dispersion of a solution, of an aqueous suspension or of an emulsion between the electrodes of an electrostatic filter are the following:

1) washing of the collector electrodes when the deposition cannot be removed by mechanical means;
2) decrease of the temperature of the gases treated, and consequently reduction of their volume flowrate through the electrostatic filter;
3) agglomeration of the dust via the liquid drops either by effect of impact or by mutual electrostatic attraction;
4) absorption and chemical treatment of the gaseous constituents capable of participating in the electrochemical corrosion of the metal structures;
5) ionic conduction by the liquid film when the structures of the electrostatic filter are not electronically conducting. This is the case, for example, when the casing is made of masonry internally lined with a coating and when the electrodes are plates of tubes or polymer materials in order to avoid electrochemical corrosion of the apparatus;
6) removal of the harmful gases such as: HCL, HF, $SO_2$, $NH_3$, $NO_x$, odours, etc., the wet electrostatic filter then acting as a bi- or triphase reactor.

DRAWBACKS

Wet electrostatic filters have, however, encountered only moderate success up until now, for the following reasons:

1) they produce transfer of the polluting substances from a gaseous effluent to a liquid effluent, and therefore solve a problem only by creating another;
2) their high cost is a deterrent as long as the pollution standards remain a weak constraint and monitoring of the industrial plant unstrict;
3) the consumption of the washing liquid, of water in general, is high and often incompatible with the local supply possibilities;
4) the technology of the apparatuses proposed takes into account neither the specificity of certain reactants used in spraying, for the requirement for depolluting the liquid effluent.

THE NEW SITUATION

The ending of prejudice against electrostatic filters/washers is due to the following new facts:

1) it is now obligatory for any potential polluter henceforth to conform with much more restrictive European standards, and consequently to invest in higher-performance apparatuses;
2) consequently, the opportunity for equipment suppliers to invest in research with a view to improving the techniques which are currently most promising, without being held back by financial constraints as severe as in the past;
3) the current research, investment and progress in the matter of treatment of water, which contribute to minimizing the drawbacks linked with the transfer of pollution;
4) the design of a "contactor with multiple stages and with counterflow between a gas and a liquid mist", exploited in the present patent in the form of an electrostatic reactor between three states, respectively liquid, solid and gaseous, constitutes a suitable technological solution to the problem of physico-chemical treatment of gaseous and liquid media within one and the same method.

SUMMARY OF THE INVENTION

An electrostatic reactor according to the invention has two functional features:

a) It purifies a gas and simultaneously concentrates the transfer liquid or liquids in a contact method with multiple stages and gas/liquid counterflow (liquid back-flow). Since the pollutant transfers take place within aerosols, the back-flow is necessarily produced from the liquid contained in the accumulation tanks which collect, via funnels, the run-off of the planar or tubular electrodes of the electrostatic filter/washer and partly recycles it into the corresponding spraying fields;
b) It combines with the gas treatment line a line for treatment of the liquids withdrawn at the particular accumulation tanks called "extraction tanks", with a view, on the one hand, to completely or partially remove the undesirable constituents by suitable separation techniques and, on the other hand, to recycle, at the particular stages, a partially or completely purified process liquid, and optionally to return into the gas treatment line regenerated reactants or liquid or gaseous residues coming from the treatment of the liquids and the sludge.

DETAILED DESCRIPTION OF PREFERRED EMBODIMENTS

The structural and operational elements of an electrostatic reactor according to the invention are: the gas treatment line, the spray field, the module, the funnel field, the accumulation tank, the extraction tank, the concentration field, the dwell time, the transfer liquid, the electric field, the liquid treatment line. These words will have, in the text, the definition given to them hereinbelow.

The "gas treatment line" or "effects line" is formed by the succession of spray fields, at each of which the transfers and the reactions between the gas and the liquid mist occur, from the input to the output of the apparatus.

A "spray field" is the space occupied by a group of electrodes frontally irrigated using a curtain of highly dispersed liquid by pipes of atomizers distributed in a plane perpendicular to the gas flow. It corresponds to an "effect" of the gas/liquid transfer. Generally, additional spraying is carried out at the upper part of a group of planar electrodes by means of the same liquid as that of the frontal spraying. An additional spraying is also possible at the top of a group of tubular collector electrodes, the frontal spraying being carried out in this case at the base, that is to say at the gas input. The composition of the spraying liquid may be the same for all the spray fields flowing into the same accumulation tank. It may be different if one make-up chemical reactant is supplied directly to the injection pipes, or if the spraying is carried out completely or partially by means of a liquid coming either from the adjacent accumulation tank or from any extraction tank after purification. The first case allows the possibility of optimizing the treatment of the gas by a particular reactant at a single spray field, the second case is a contribution to the flow-back by a path other than that of the direct liquid transport from one accumulation tank to the next, the third case has the advantage of decreasing the entrainment by the gases, from one spray field to another, of the pollutants contained in excessively concentrated liquid vesicles.

The multiplication of the spray fields has two advantages;

a) The flow rate, the composition and the spatial distribution of the primary mist can be adapted, at each spray field, to the local and temporal characteristics of the gas stream (temperature, humidity, chemical composition of the gases, continuous or discontinuous emission regime);

b) It is possible to produce a continuous liquid film at the surface of the collector and emitting electrodes, avoiding, on the one hand, an excess run-off which are responsible for excessively frequent short-circuits by the uninterrupted liquid crickle between the bottom of a high-voltage electrode and the casing and, on the other hand, regions of drying responsible for local burning of the electrodes when they are manufactured from an electrically insulating organic material.

The "module" is a section of the gas treatment line. It itself has all the features of an electrostatic filter/washer, namely a casing containing the electrodes, the fluid inputs and outputs and the electrical supplies. An electrostatic reactor according to the invention may consist of a single module, in this case of planar electrodes, it necessarily has several in the case of cylindrical electrodes, but it necessarily includes, in all cases, at least one concentration field having backflow and multiple stages. In the case of an apparatus having planar geometry, a module may include one or more concentration fields with back-flow. In the case of an apparatus with cylindrical geometry, a concentration field with back-flow is necessarily formed by several modules, each constituting one spray field.

The modular construction has numerous advantages:

a) The apparatus which satisfies the specifications of the schedule of conditions may advantageously be produced by a suitable combination of standard modules, arranged in series and/or in parallel.

b) The constructional materials of each module may be chosen as a function of the more or less corrosive local compositions of the gas and of the liquid along the treatment line for the two fluids.

c) As regards electrostatic filters with planar geometry, the modular design overcomes to some extent the hindering of the gases at the top and at the bottom of the casing.

A "field of funnels" is the apparatus section to which an accumulation tank is assigned which collects, using one or more funnels, the sludge or the concentrated solutions which flow at the base of a spray field or several spray fields. The liquid collected is partly recycled by spraying in the same field of funnels, allowing possible adaptations of its chemical composition, partly drawn off to produce the liquid flow-back from stage to stage, and partly withdrawn at the extraction tanks with a view to eliminating the undesirable transfer products by means of suitable separation methods (precipitation, sedimentation, filtration, centrifuging, pH adjustment, chemical reactions, etc.).

The multiplication of the fields of funnels, that is to say of the accumulation tanks has several advantages which we shall now specify:

a) The possibility of subjecting the gas to successive treatments, on line, by liquids of different compositions, which constitutes one of the innovations of the apparatus, response to the concern of treating the gas which have been most heavily loaded using the least expensive reactants, of adapting the composition of the liquid reactant to the local and temporal composition of the gas and of reserving the last spray fields for the use of highly specific reactants for the transfer of certain residual gaseous pollutants;

b) The concentration of the pollutant as far as the extraction tanks, obtained by acting simultaneously on two mechanisms, on the one hand recycling the spray liquid at one and the same field of funnels and, on the other hand, the multiple-stage back-flow produced by transport of the liquid from one accumulation tank to the next, which also constitutes an innovation of the apparatus, makes it possible to optimize the specific treat-ments of the gas and those of the liquids with a view to removing the undesirable products in the form either of solids or of upgradable concentrated solutions. The back-flow of liquid may follow two paths, that of the direct transport from one accumulation tank to the next, or that which consists in taking off the liquid from one accumulation tank in order to carry out continuous or discontinuous partial additional spraying flowing into the adjacent accumulation tank.

The "concentration field", which ends in an extraction tank, is the apparatus section to which the concentration of certain transfer pollutants by liquid/gas contact with back-flow and multiple stages is devoted. In the case of electrodes with planar geometry, it therefore comprises several fields of funnels, that is to say several accumulation tanks constituting the stages. In the case of cylindrical collector electrodes, it necessarily comprises several modules and as many accumulation tank. The electrostatic reactor according to the invention necessarily has at least one concentration field.

A "sequential dwell time" is the average time which the gas takes to cover a particular section of the treatment line:

spray field, field of funnels, concentration field or gas treatment line. In the case of dust removal, it varies proportionately to the "surface area per unit volume of electrodes in the corresponding section", that is to say the surface area of electrodes contained in this section per standard cubic meter of gas passing through the apparatus in one hour. In modular production, it can be varied by assigning a greater or lesser number of modules in series or in parallel to a particular treatment sequence. If the dwell time necessary for removing a gaseous pollutant is higher than that necessary for the electrostatic precipitation of the dust which accompanies it, a washer (nonelectrostatic) for the gas may be placed at the head or at the tail of the electrical purifier. The number of degrees of freedom necessary for adjusting the characteristics of the purifier as a function of the rates of the chemical reactions in question and of the antipollution standards in force are thus available.

The composition of the "transfer liquid" either in the nebulized state or in the state of run-off collected in the accumulation tanks, varies along the gas treatment line because, on the one hand, of the specificity of the reaction in question and, on the other hand, of the concentration with multiple stages and gas/liquid counterflow produced either by direct transport of the liquid from one accumulation tank to the next or by continuous or discontinuous partial spraying of a group of electrodes using the liquid coming from the accumulation tank of the adjacent stage or coming from a withdrawal and purification operation carried out at an extraction tank; during the spraying sequence, the end of the group of electrodes is correctly washed, but a part of the liquid mist and the pollutants which it contains are entrained from one stage to the next by convection, which effect is unfavourable for strong concentration of the sludge and for strong purification of the gas; during the stop sequence of the spraying, the drops are electrostatically precipitated at the stage where they are produced and therefore do not participate in the reentrainment of purities carried by the liquid mist. The composition may also vary from one spray field to another if reactants are introduced directly into the irrigation pipes as a complement to those introduced into the tanks. The composition of the "spraying liquid" is determined by the nature and the kinetic characters of the transfer reactions which are assigned to one spray field, one funnel field, or one concentration field. It most generally involves water containing soluble reactants, reactive or inert solids in the dispersed state, catalysts, optionally ionic or nonionic surfactant products or alternatively emulsified oil-absorbing substances.

An "electric field", according to its classical definition, is the space occupied by one or more groups of electrodes supplied by one and the same electric generator. The multiplication of the electric fields has well known advantages;

a) It avoids stoppage of the precipitation of the particles simultaneously in all the sections of the apparatus. The temporary interruption of the sedimentation, following local electrical start-up, concerns only the electrodes supplied by a single transformer, that is to say a single electric field.

b) It is possible to adjust the electrical voltage as close as possible to the local breakdown voltage, in order to optimize the rate of sedimentation of the solid or liquid particles in suspension in the gas. This disruptive voltage is, in fact, dependent on numerous factors such as: density of particles in suspension in the gas, distribution of the size of these particles, chemical composition, temperature and homogeneity of the gas, anomalies of centering or parallelism of the electrodes, configuration of the edges and of the emissive points. In a triphase electrostatic reactor, the chemical composition of the gas may vary considerably between the input and the output of the apparatus. In the case of a single electric field, it is the section of the gaseous stream which has the lowest breakdown voltage which imposes this voltage on all the other sections, to the detriment of the overall efficiency of the apparatus. It is known, for example, that a high $SO_2$ content significantly lowers the disruptive voltage. The first spray field (or fields) will therefore have the function of stopping most of the $SO_2$ using a suitable reactant, but under a relatively low electrical voltage, whereas the following fields will withstand higher voltages adapted to the optimal local efficiencies. A "lane" is the space contained between the two collector electrodes on either side of an emitting electrode in the case of an electrostatic filter with planar geometry.

The "liquid treatment line" is that of the physical and chemical operations carried out on the concentrated liquids withdrawn at the extraction tanks with a view, on the one hand, to removing the undesirable products and, on the other hand, to partially or completely recycling, at suitably chosen points on the gas treatment line, the washing liquids thus totally or partially purified, and optionally regenerated reactants.

DETAILED DESCRIPTION OF THE DRAWINGS

Figure 1:
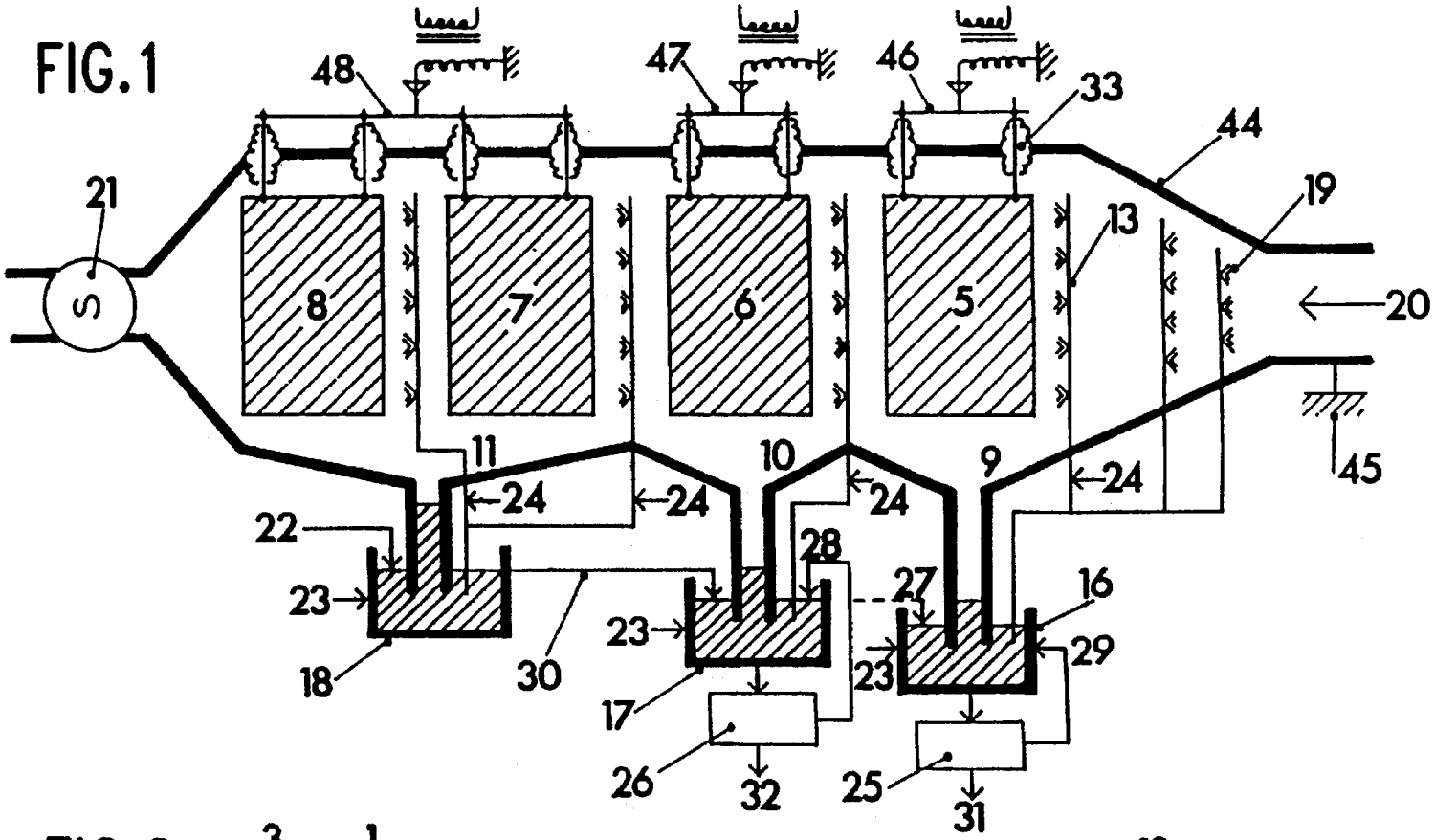
FIG. 1: is a view in longitudinal vertical section of a wet electrostatic filter with liquid/gas counterflow.
Figure 2:
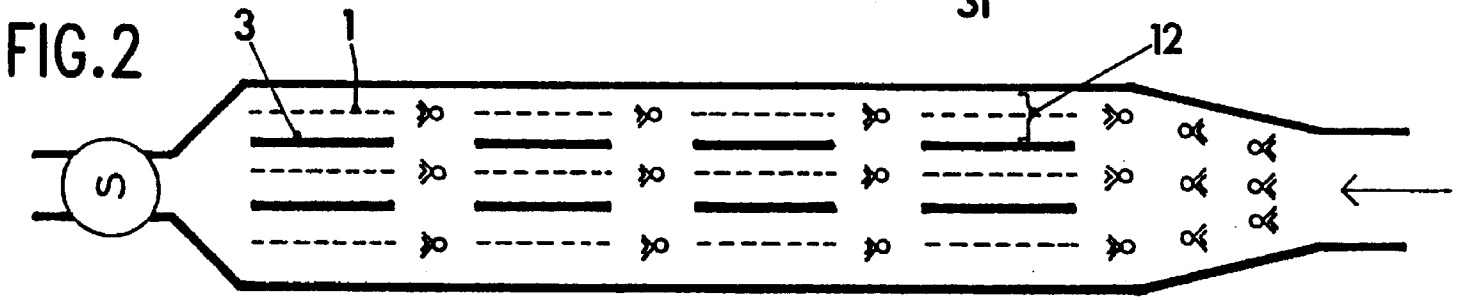
FIG. 2: is a plan view of the electrostatic filter represented by the preceding figure.

By way of non-limiting example, FIG. 1 and FIG. 2 represent, diagrammatically and respectively in vertical and horizontal section, an apparatus with planar geometry having three "electric fields" 46, 47, and 48. It comprises a casing 44, four spray fields 5, 6, 7, 8, and three funnel fields 9, 10, 11, the first two 9 and 10 each including a single spray field, and the third 11 having two spray fields, 7 and 8. Each of the spray fields includes three "lanes" such as 12 and are each irrigated by vertical spray pipes such as 13. Planar collector electrodes 3 define the lanes 12, and the dashed lines designate emitter electrodes 1 centered in each lane 12. Other pipes such as 19 ensure the water vapour saturation of the gas entering into the apparatus. These spray pipes 19 may advantageously form part of a head stage assigned to drying the sludge by the sensible heat of the gas in order finally to obtain solid or pasty products. Two accumulation tanks 17 and 18 participate in a concentration field having two stages whose back-flow passes through the pipe 30, the tank 17 being an extraction tank as is the tank 16. Ceramic or silica components 33 support the emitting electrodes and insulate them from the earth 45. Also provided are a gas inlet 20, a gas extractor 21 and an inlet 22 of the recycled liquid after its purification in the liquid treatment line, or that of the make-up liquid of the method. The reactants are introduced into the accumulation tanks at 23, and optionally, and for some of them, directly into the spraying pipes at 24. The undesirable products are removed in the liquid treatment line including separation units 25 and 26 operating on withdrawals from the extraction tanks 16 and 17. In the example provided, the tanks 16, 17 and 18 may optionally participate in the back-flow concentration of certain pollutants not removed at 26 if the incompletely purified liquid is transported by the pipeline 27 to the accumulation tank 16. In this case, the three funnel fields constitute a back-flow concentration field for these particular pollutants. The undesirable products are extracted from the liquid treatment line at 31, and 32, in the form of optionally upgradable solid precipitates, highly concentrated sludge intended for discharge, industrially recyclable solutions, or completely or partially purified liquid recycled into the gas treatment line through pipelines such as 22, 28, 27 or 29.

Figure 3:
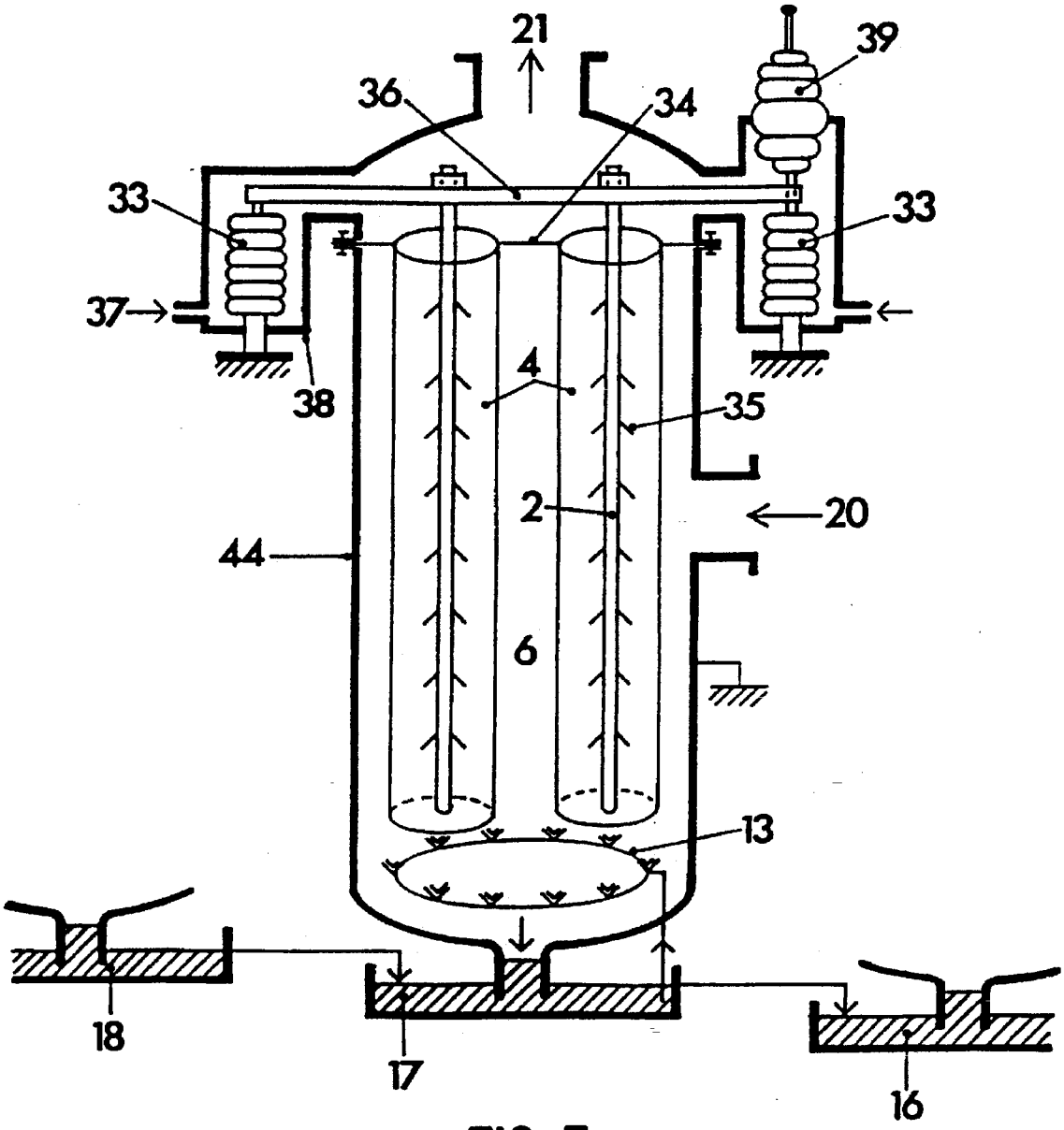
FIG. 3: is a view in vertical section of a bundle of tublar electrodes constituting one of the stages of a wet electrostatic filter with liquid/gas counterflow.
Figure 4:
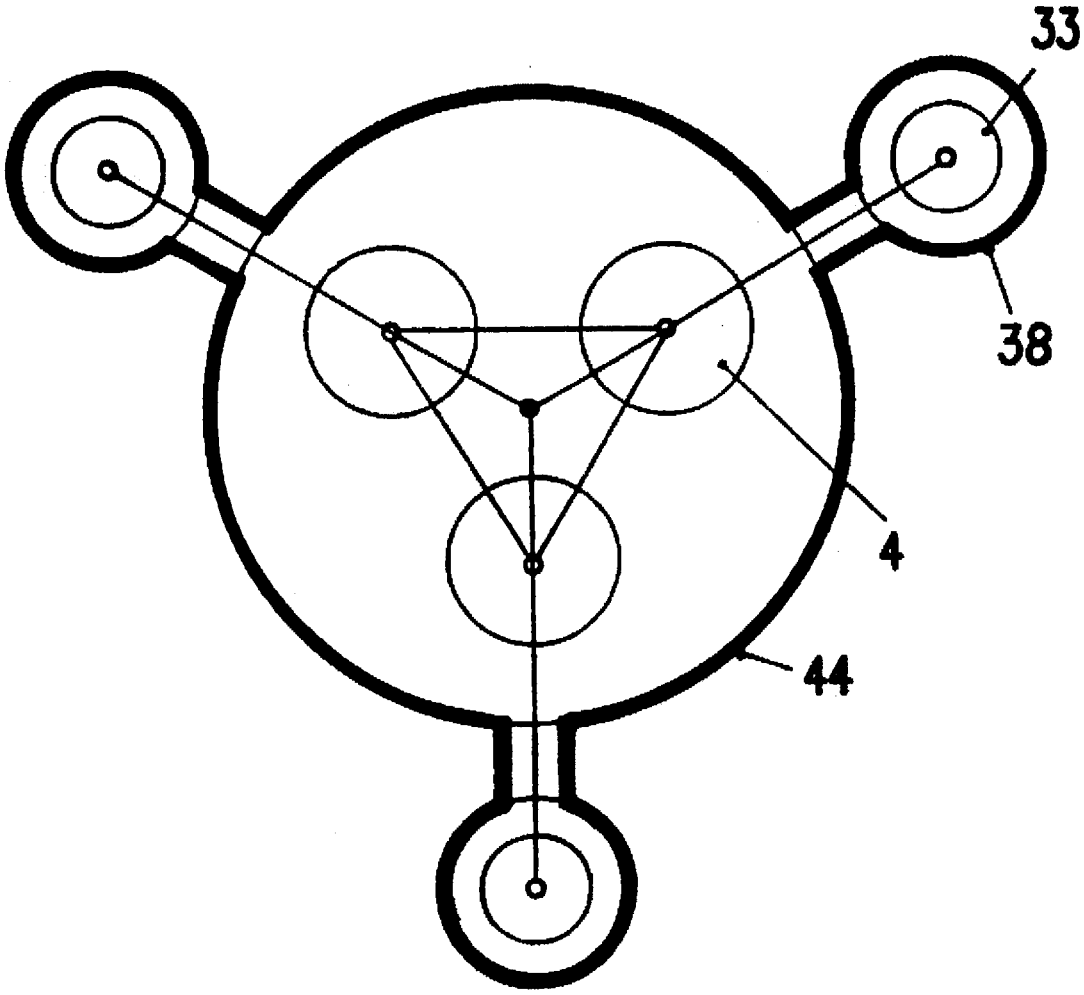
FIG. 4: is a plan view of the stage represented by the preceding figure.

By way of non-limiting example, FIG. 3 and FIG. 4 represent, diagrammatically and respectively in vertical and horizontal section, at the same time a module and spray field 6. A frontal spraying pipe 13 is provided in the spray field 6. The three accumulation tanks 16, 17 and 18 participate in a back-flow concentration field consisting of three modules such as 6. Cylindrical electrodes such as 4 are fastened to a plate 34. The emitting electrodes such as 2, which carry asperities such as 35 having electric field effect, are suspended from a network of beams 36 supported and insulated from the earth by ceramic or vitreous fused silica blocks such as 33. An intake 37 provides air that sweeps through the protective case 38 of the insulator 33 which is, furthermore, optionally heated and thus protected from moisture and contact with the gas to be treated. An intake 20 and an outlet 21 for the gas are also provided along with a high-voltage terminal 39.

Figure 5:
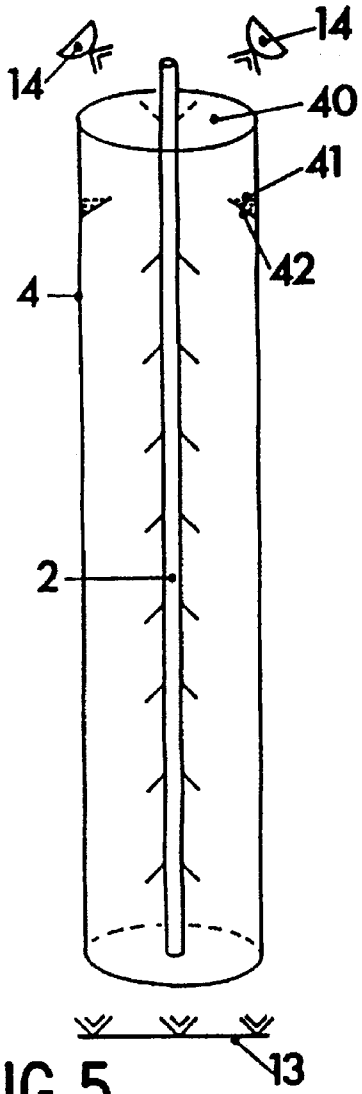
FIG. 5: is a view in vertical section of a cylindrical collector electrode and of the corresponding emitting back-electrode, with various spray devices.

By way of non-limiting example, FIG. 5, which relates to the case of a cylindrical collector electrode 4, represents the frontal spraying pipe 13 arranged at the base of the cylinder at the gas intake, and the additional spraying device making it possible to supply the top of the emitting electrode 2 with run-off water. This liquid is provided either by primary spraying carried out using atomizers such as 14 and is then collected partly by a conical collar 40 which flares upwards and is perforated at its connection with the electrode 2, or by electrostatic nebulizing of the liquid 41 coming from the same primary spraying and collected by run-off in the conical collar 42 which is flared upwards and fastened by its base to the top of the collector electrode.

Figure 6:
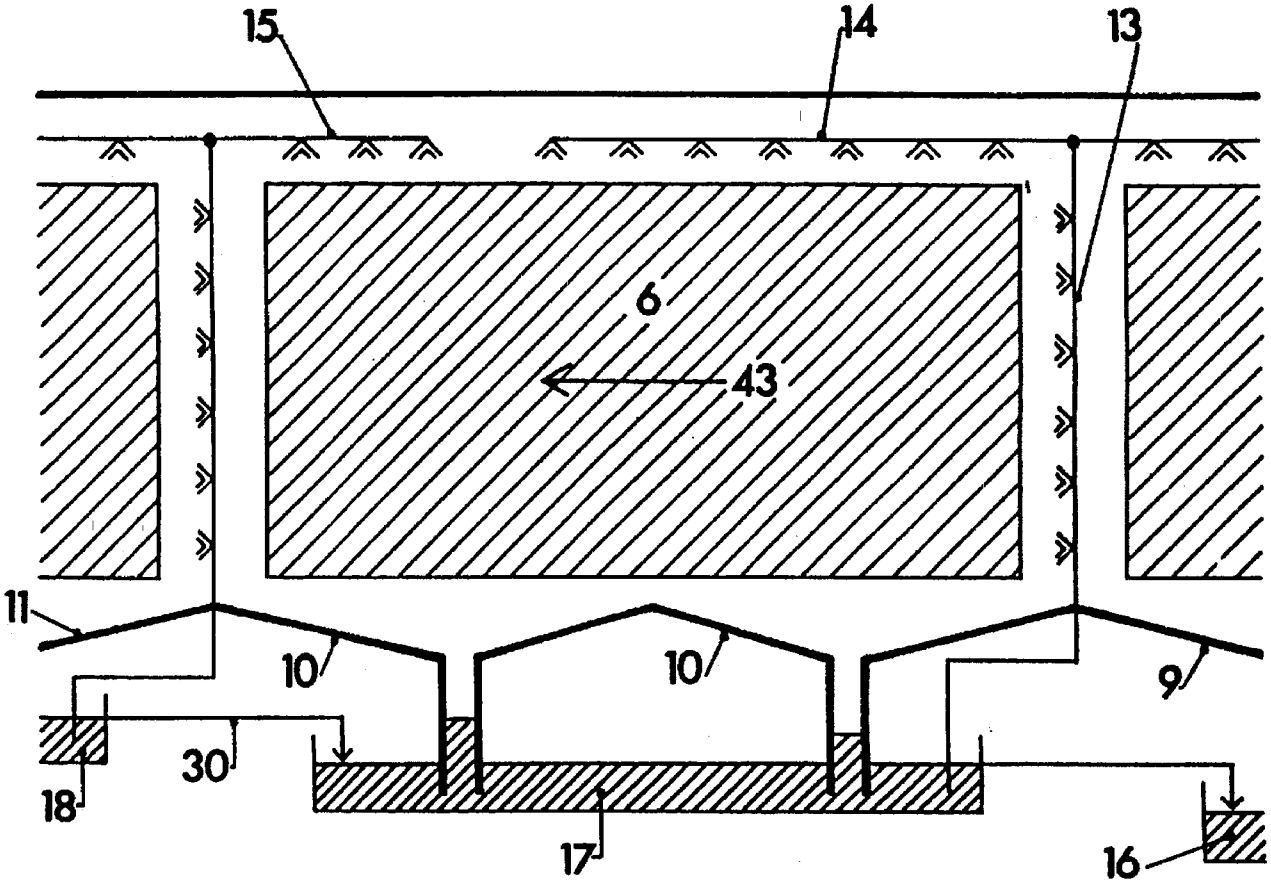
FIG. 6: is a view in vertical section of a spray field with vertical spray pipes and horizontal spray pipes, the run-off from the electrodes being collected by two funnels into a single accumulation tank constituting one of the concentration stages of a planar wet electrostatic filter with liquid/gas counterflow.

By way of non-limiting example, FIG. 6, which relates to planar electrodes, represents the single spray field of a field of funnels 10 (itself belonging to a concentration field with back-flow having at least three stages 16, 17, 18), the atomization pipes of which are of three types: vertical pipes 13 arranged frontally in front of a group of planar electrodes 6, horizontal pipes 14 that irrigate the first part of the group of electrodes 6 from above and are supplied by the same recycled liquid from the accumulation tank 17. Horizontal pipes 15 irrigate, continuously or discontinuously, the second part of the group of electrodes 6, also from above, but are supplied with the liquid coming from the accumulation tank 18. This third type of pipe, where it exists, constitutes one of the liquid back-flow paths from the stage 11 to the stage 9, the other back-flow path being that of the pipeline 30 which directly conveys, by gravity or by means of a pump, the liquid from the tank 18 to the tank 16. The direction of the gas flow is designated as 43.

The reactor includes a field of funnels or a final module intended for cumulative analysis of the traces of harmful products, the continuous metering of which becomes impossible in the case of excessively severe standards.

The reactor constitutes a mobile unit for cumulative analysis of industrial gaseous effluents.

I claim:

1. A method for purifying gaseous effluents including fine dust particles, said method comprising:

directing gas in a first direction within a common chamber having a plurality of stages, each of said stages including at least one liquid spraying nozzle;

spraying liquid through each said spraying nozzle of each of said stages and between and in contact with surfaces of a plurality of collector and emitting electrodes provided in each of said stages, said liquid making intimate contact with said gas;

collecting the liquid in accumulation tanks corresponding to each said plurality of stages;

increasing concentration of the fine dust particles within the liquid by recirculating the liquid from each accumulation tank back through a spraying nozzle corresponding to each of said stages; and diluting the concentration of the fine dust particles within the liquid by transporting the liquid in a second direction countercurrent to the first direction, as a reflux from stage to stage until the fine dust particles are removed, at least a portion of said reflux providing one of intermittent and continuous flow of collected liquid from a selected accumulation tank to a downstream portion of a stage located upstream of the selected accumulation tank, and another portion of said reflux being provided directly from said selected accumulation tank to an upstream accumulation tank.

2. The method according to claim 1, further comprising:

charging said surfaces of said emitting electrodes to a predetermined particle charging voltage; and controlling said spraying of liquid in the direction of the emitting electrodes to ensure homogenous electrostatic liquid spraying at asperities of said emitting electrodes at the predetermined particle charging voltage.

3. The method according to claim 2, further comprising:

spraying water liquid to evacuate the fine dust particles precipitated by the collector electrodes; and introducing specific reactants to the water liquid of at least one predetermined tank to perform any necessary absorption of predetermined gaseous pollutants.

4. The method according to claim 3, further comprising:

collecting the liquid in at least one extraction tank; and partially purifying the liquid before recirculating the liquid countercurrently to said first direction.

5. An apparatus for purifying gas by removing fine dust particles, said apparatus comprising:

a common chamber having at least first and second stages for electrostatically removing fine dust particles from a gas moving in a first direction, each of said stages having at least one spraying nozzle for directing liquid into intimate contact with an incoming gas stream;

at least first and second collecting and emitting atomizing electrodes provided, respectively, in each of said at least first and second stages;

liquid accumulation tanks provided within said common chamber, each of said liquid accumulation tanks corresponding to one of said at least first and second stages;

a liquid recirculation system for recirculating said liquid directly between a first accumulation tank and at least one of a first spraying nozzle corresponding to said first accumulation tank and a second spraying nozzle corresponding at least partially to a second accumulation tank positioned upstream of the first accumulation tank; and a liquid circulation system for circulating said liquid from said first accumulartion tank directly to the second accumulation tank, and for diluting the concentration of the fine dust particles within the liquid by transporting the liquid in a second direction countercurrent to the first direction, as a reflux from stage to stage until the fine dust particles are removed, at least a portion of said reflux providing one of intermittent and continuous flow of collected liquid from a selected accumulation tank to a downstream portion of a stage located upstream of the selected accumulation tank, and another portion of said reflux being provided directly from said selected accumulation tank to an upstream accumulation tank, wherein said at least first and second stages and said liquid circulation and recirculation systems contribute to removing of said fine dust particles from said gas.

6. An apparatus according to claim 5, further comprising a system for continuously supplying predetermined reactants to the liquid of at least a selected one of said stages, thereby eliminating by absorption gaseous pollutants of the gas.

7. An apparatus according to claim 6, further comprising a separation unit for partially purifying the liquid of at least one of the accumulation tanks, and for reintroducing the purified liquid as reflux.

* * * * *